United States Patent [19]

Booth et al.

[11] 4,153,503

[45] May 8, 1979

[54] METHOD OF WET-FORMING MINERAL FIBERBOARD PRODUCT HAVING DAMAGE-RESISTANT OVERLAY

[75] Inventors: Alfred E. Booth, Westfalen, Fed. Rep. of Germany; Daniel W. Schutter, Millersville, Pa.

[73] Assignee: Armstrong Cork Company, Lancaster, Pa.

[21] Appl. No.: 347,050

[22] Filed: Apr. 2, 1973

[51] Int. Cl.[2] ..... D21F 11/00

[52] U.S. Cl. ..... 162/123; 162/128; 162/129; 162/145; 162/181 R; 162/181 C; 162/181 D; 162/206; 162/225; 428/308

[58] Field of Search ..... 162/123, 145, 147, 152, 162/201, 202, 181 R, 225, 156, , 181 C, 181 D, 128, 129; 161/205, 206; 117/126 R; 106/DIG. 2, 288 B; 428/538, 2, 308, 304, 537, 452

[56] References Cited

U.S. PATENT DOCUMENTS 2,108,761 2/1938 Becker ..... 162/181 R 2,634,207 4/1953 Miscall et al. ..... 162/181 R 3,373,074 3/1968 D'Eustachio et al. ..... 428/308

FOREIGN PATENT DOCUMENTS 805636 2/1969 Canada.

*Primary Examiner*—S. Leon Bashore

*Assistant Examiner*—Peter Chin

[57] ABSTRACT

A mineral board product is formed having a low density backing layer and a high density damage-resistant surface layer on conventional fourdrinier equipment in a continuous wet-laid process by initially forming a low density water-laid sheet by flowing a slurry of the board-forming materials onto the wire of a fourdrinier and, at that point on the wire where the mat has formed but at which the water content is between about 7.0 and 12.0 percent, a surfacing layer is applied by means of a secondary head box to the mat, the slurry forming said surfacing layer having a slurry consistency of between about 10 and 15 percent and a Canadian Standard Freeness of between about 150 and 300.

12 Claims, 1 Drawing Figure

FLOW DIAGRAM
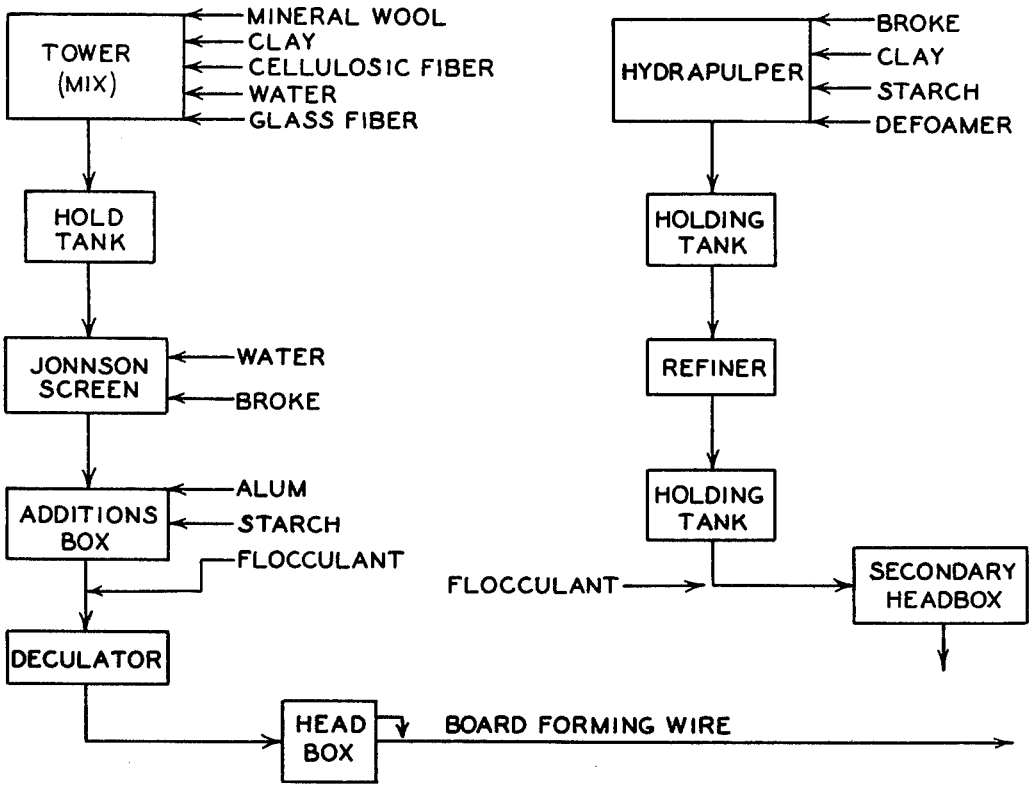

METHOD OF WET-FORMING MINERAL FIBERBOARD PRODUCT HAVING DAMAGE-RESISTANT OVERLAY

BACKGROUND OF THE INVENTION

1. Field of the Invention

This invention relates to a method for manufacturing mineral-fiberboard products typically of the type used for acoustical ceilings and is more particularly directed to a low density board having a damage-resistant dense surfacing layer.

2. Description of the Prior Art

The formation of fiberboard products having two or more layers of differing properties is known in the art and various techniques for achieving fiberboard products having surfacing layers which differ from the backing layer to which they are applied are exemplified by British Pat. No. 1,064,091, U.S. Pat. No. 1,996,343, U.S. Pat. No. Re. 27,109, and U.S. Pat. No. 3,513,009.

SUMMARY OF THE INVENTION

It is an object of this invention to provide a low density mineral fiberboard product, formed by flowing a slurry onto conventional fourdrinier type board-making equipment, with a relatively high density damage-resistant surfacing layer which is applied through a secondary head box directly to the water-laid sheet formed at the primary head box at a point such that the drainage characteristics ensure a unitary board having two layers of differing properties. We have found that it is critical to the continuous board formation technique described to carefully control the solid content of the low density backing sheet at the point at which the slurry forming the high density overlay layer is applied and also to carefully control the consistency of the slurry forming the high density facing layer as well as controlling the densification ability of said slurry through control of the freeness of such slurry.

DESCRIPTION OF THE DRAWING

The FIGURE of the drawing is a flow diagram setting forth schematically the process of this invention.

DESCRIPTION OF THE PREFERRED EMBODIMENTS

The description of the preferred embodiments is made with reference to the flow diagram.

A conventional mineral wool fiberboard-forming slurry is formed by mixing, based on the total weight of dry ingredients, from 46 to 75 percent by weight of mineral wool, from 5 to 22 percent by weight of cellulosic fiber, from 0 to 25 percent by weight of perlite, from 0 to 15 percent by weight of clay, from 4 to 8 percent by weight of organic binder, from 0 to 1 percent by weight glass fiber, from 0.1 to 0.4 percent by weight of alum, and from 0.01 to 0.04 percent by weight of a surface-active flocculating agent together with sufficient water to make up a slurry having a total solids of from 1.5 to 4.5 percent by weight. Generally speaking, we have found that the utilization of tapioca starch as a binder results in better board formation characteristics. Newsprint is generally used as the source for the cellulosic fibers.

The ingredients, together with the water necessary to make up the slurry consistency, are added as shown in the Drawing to conventional mixing and holding equipment from which they are flowed onto the board-forming wire of a fourdrinier through a conventional head box. As they flow out onto the continuously moving wire of the fourdrinier, a water-laid mat of relatively low density is formed. At that point, at which the percent solids in the water-laid mat is approximately 7 to 12 percent by weight, we have found that a self-sustaining sheet is formed to which a higher density surfacing layer may be applied. This is applied by means of a secondary head box through which a slurry of 10 to 15 percent by weight solids flows onto the self-sustaining sheet. At this point the drainage characteristics of the lower density sheet are such that the water from the latter applied slurry readily flows into and through the sheet and the second layer formed on drainage knits to form a unitary sheet but yet maintains its own distinct characteristics. By carefully controlling the freeness of the second slurry to a Canadian Standard Freeness* of between about 150 to 300, the densification capability of the slurry forming the second layer is achieved. This freeness, contrasted to a Canadian Standard Freeness of between about 400 and 750 for the slurry forming the basic layer, is achieved by additional refining and more intensive mixing of the ingredients in the slurry as shown in the Drawing, both a hydrapulper and refiner being used. As indicated in the Drawing, some of the ingredients are added in the form of broken or recycled materials from earlier runs.

*Canadian Standard Freeness determined by TAPPI method T-227, Freeness of Pulp

The ingredients used in forming the slurry applied at the secondary head box, based on percent by weight of solids, include mineral wool (from 20 to 35 percent by weight), cellulosic fibers (from 7 to 14 percent by weight), perlite (from 7 to 15 percent by weight), organic binder (from 7 to 14 percent by weight), again tapioca starch is preferred, clay (from 25 to 55 percent by weight), glass fiber (from 0 to 0.5 percent by weight), and a surface-active flocculating agent (from 0.03 to 0.15 percent by weight). A defoamer may also be added at the hydrapulper. After passing onto the water-laid sheet formed on the wire under the secondary head box, suction is applied to drain water from both layers and pressure is applied if desired to further assist in drainage and assist in compaction using conventional means well established in the art.

On drying, a board is formed which has a low density backing layer of 1.0 to 1.25 pounds per board foot (1.0 to 1.5 pounds per board foot if pressed) and a high density surface layer of 1.75 to 2.50 pounds per board foot (2.75 to 3.50 pounds per board foot if pressed). The following example will serve to more fully illustrate the invention.

EXAMPLE 1

In forming the low density base sheet, the following formulation was added to a conventional mixer together with sufficient water to form a slurry of about 3 percent solids consistency, the ingredients being added at the tower, Jonnson Screen, and additions box as

| Ingredients | Percent by Weight Solids |
|---|---|
| Mineral wool | 50.6 |
| Cellulosic fibers from newsprint | 18.7 |
| Perlite | 20.0 |
| M&D clay | 4.4 |
| Tapioca starch | 6.1 |
| Alum | .22 |
| Surface-active flocculating agent (Polyox WSR301) | .02 |

12. A process for producing coated thermal and acoustical structural material comprising:

a. Mixing a thermally expanded mineral aggregate, a defibrillated fibrous material and a binder;

b. Depositing a sufficient amount of said composition on a board-forming machine to form a mat of desired thickness and consistency;

c. Partially dewatering said mat in amount sufficient to remove the water glaze therefrom;

d. Applying to the still wet surface of the deposited mass a coating comprising mineral fibers, defibrillated fibrous materials, and binder; and then e. Dewatering, pressing and drying said mass.

* * * * *